US006026637A

United States Patent [19]

Dombre et al.

[11] Patent Number: 6,026,637

[45] Date of Patent: Feb. 22, 2000

[54] WRISTLET WITH ARTICULATED LINKS

[75] Inventors: Christian Dombre, Annemasse; Daniel Moille, Messery; William Passaquin, Thonon-les-Bains; Yvan Serikoff, Ville la Grand, all of France

[73] Assignee: Montres Rolex S.A., Geneva, Switzerland

[21] Appl. No.: 09/260,639

[22] Filed: Mar. 2, 1999

[30] Foreign Application Priority Data

Mar. 20, 1998 [EP] European Pat. Off. ..... 98810244

[51] Int. Cl.[7] ..... F16G 13/08

[52] U.S. Cl. ..... 59/80; 59/82

[58] Field of Search ..... 59/80, 78, 81, 59/82

[56] References Cited

U.S. PATENT DOCUMENTS 5,502,962 4/1996 Butti ..... 59/80

FOREIGN PATENT DOCUMENTS 0 310 536 4/1989 European Pat. Off. .
0 310 536 B1 4/1991 European Pat. Off. .
2453678 5/1975 Germany ..... 59/82
37 32 920 C2 2/1990 Germany .
269271 6/1950 Switzerland ..... 59/80
655836 5/1986 Switzerland ..... 59/82
664267 2/1988 Switzerland ..... 59/82
WO 93 08713 5/1993 WIPO .
WO 93 13686 7/1993 WIPO .

*Primary Examiner*—David Jones
*Attorney, Agent, or Firm*—Henderson & Sturm LLP

[57] ABSTRACT

Wristlet comprising at least three rows of links side by side, the links of two lateral rows with the links of the center row forming modular units articulated between them around transverse axles. The two lateral opposed sides of the center link on the one hand and the internal lateral die of the lateral links of each modular unit on the other hand are interdependent with means to fit these links laterally one in each other in a defined position. The organs for articulating the contiguous modular units are associated to locking organs, elements joining these locking organs to the fitting means to maintain the links of each modular unit fitted one in each other.

20 Claims, 3 Drawing Sheets

WRISTLET WITH ARTICULATED LINKS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OR THE INVENTION

1. Field of the Invention

The present invention concerns a wristlet having articulated links, comprising at least three longitudinal rows of links side by side, whose links are longitudinally staggered from one row to the other, the links of the two lateral rows being located vis-à-vis from each other, each pair of lateral links forming, together with a link from the center row, a modular unit, these units comprising organs articulating between each other around transverse axles piercing respective parts of contiguous modular units which materially interpenetrate.

2. Description of the Prior Art

Wristlets formed by a plurality of links articulated one with the other around axles located transversely to the wristlet have been known for a very long time, notably for watch wristlets. Generally, articulations between these links are realized by pins which are forced into the lateral links, to allow these links to pivot with the center links.

In order to allow these wristlets to be worn at the right length, i.e. the length which allows adaptation to the wearer's wrists, links located near an extremity of the wristlet are assembled by screws rather than forced pins, in order to allow the extra links to be removed. These screws are visible from outside and they appear most often on the side of the wristlet, which is detrimental to the appearance.

Another drawback of these wristlets is the difficulty arising in case of repair. If a link has to be replaced because it was damaged, it is not possible to easily separate the links capped together by forced pins and this work can be done only with an adapted tooling as well as a know-how, which may not be available to the repair person, so that the wristlet has to be returned to the manufacturer, leading to delays which can be long, depending on the country where the manufacturer one is located.

It has already been proposed to make such wristlets entirely dismountable. Accordingly, EP-0 118 774 and CH-664 475 disclse two wristlets with articulated links entirely assembled by fixing screws which are screwed laterally in order to connect the links together with the pivoting organs or members between the links. Such wristlets solve part of the problem since they allow taking the wristlet completely apart and to replacement of any link. However, the fixing screws are visible along the whole length of the wristlet, which is detrimental to the appearance.

EP-0089 421, WO 93/0871 and WO 94/12069 concern dismountable articulated wristlets, assembled by articulating elements freely engaged on pivoting pens, these articulating elements being locked by organs which are screwed on the side of the wristlet which faces the wearers arm, so that the screws are not visible when the wristlet is worn. This represents undoubtedly an improvement of the aesthetics, but would nevertheless not fulfill the most exacting requirements of high-end articles. Indeed, in a shop-window or when purchasing, the customer first sees the wristlet not worn, and can notice the fixing screws on whatever the side of the wristlet on which they appear. Seeing fixing screws immediately confers to such a wristlet the character of an object whose functional aspect dominates the aesthetical aspect, which is of course not adequate for a high-end article of this type, whose faultless appearance is a testament of good manufacturing.

Patent CH-558 153 concerns an articulated wristlet comprising links joined to a transverse articulating rod which protrudes at one extremity of the link and which does not extend on the entire width. This rod is introduced in a recess which opens on the interior side of the contiguous link and is maintained in position by a spring-mounted locking element. In this case, the screws are replaced by a spring. In the case of a gold wristlet, such a spring could hardly be in the same metal as the wristlet. Moreover, even if it is not a screw, the fixing organ must have an opening in order to allow the assembling, and thereby keeps a functional and non ornamental character or simply an appearance whose aesthetics fail to go along with the remaining of the wristlet.

Another type of solution has been proposed in order to solve this problem. There are articulated wristlets in which the articulating mechanism is lodged in links which are formed by sleeves covering each of the segments forming the wristlet. Such solutions where disclosed in CH-653 871 as well as in EP-0 540 979. In this type of wristlets, the visible link extends necessarily on the entire width of the wristlet. Accordingly, this solution does not apply to wristlets formed by side by side rows of staggered links in order to obtain specific ornamental effects, notably with links made of several materials having different colors and/or with different surface finish.

Another solution has been proposed in CH-688 430, and consists in forming links comprising three parts of differing widths, longitudinally staggered with respect to each other. A narrow center part is followed by a medium width part extending from one side to the other of the middle axle of the wristlet and finally by a part whose width corresponds to that of the wristlet. Each center part and each middle width part is transversally pierced at the wristlet. Each wide part of the link comprises a recess of a width corresponding to the middle width, and each middle part comprises a recess having a width corresponding to the narrowest center part. Thereby, two contiguous links can imbricate the one in the other and be retained together by a barrette which is sliding in the transverse coaxial openings of the middle part and of the center part of the contiguous link. This barrette passes freely through these openings but is actually retained when the next link is placed. Indeed, the barrette strikes against the edges of the recess of corresponding width of this next link and is accordingly actually stopped.

Such a wristlet is entirely dismountable. Appears, at first glance, to be formed of several rows of staggered links, however, two rows are actually constituted by only one link. Consequently, color combination by rows of links in different materials are not possible with this solution.

It has already been proposed in EP 0 310 536 a wristlet formed by five rows of side by side links, of which at least the links of both lateral rows are staggered longitudinally with those of the other rows. The internal lateral side of each of these lateral links comprises a half axle, the free extremity of which ends by a pivoting head shaped as a spherical segment adjacent to a groove linking this head to the cylindrical part of this half axle. The latter is engaged in a boring which pierces a middle link, in which only the head at the extremity and the main part of the groove protrude from the internal lateral side of this middle link.

The center link comprises a sliding way which extends longitudinally and is open at one extremity. The transverse section of this sliding way is shaped as a spherical segment corresponding to that of both heads of both half-axles of both lateral links which are located opposite from each other. In addition, this sliding way comprises two longitudinal slits opening on its lateral opposed sides and hose width sensibly corresponds to the diameter of the grooves which are contiguous to the end heads. The middle and the center links also include a transverse boring.

In order to assemble this wristlet, one must engage each half-axle in one of the borings of the middle links, then engage the heads of the half-axle in the sliding way of the center link. One then slides these heads until the second boring of the middle links are coinciding with the boring of the center link and puts an axle is put through them which maintains the five links assembled and allows the articulation of the lateral links of the contiguous modular unit. Such a conception realizes a wristlet which is screwless and without any visible fixation.

Nevertheless, this concept of wristlets presents drawbacks. Notably it does not allow to realize a wristlet comprising only three rows of links, the middle links being indispensable. Each link is articulated around two parallel axles, so that the links of a modular unit cannot be fixed one with the others. Moreover, the linking of the links by articulating elements and screwless sliding elements necessitates some clearance, which confers to the wristlet a less solid appearance, which can lead to the impression of a lesser quality, which is not acceptable for so-said high-end products.

BRIEF SUMMARY OF THE INVENTION

The present invention aims to remedy, at least in part, to the drawbacks of the above-mentioned solutions. To this effect, this invention concerns a wristlet having articulated links of the type previously, defined and corresponding to the claims.

The lateral fitting of the links for the different rows realizes a wristlet with links which are formed by entirely dismountable modular units, the fitting links of a same unit being interdependent with the others. The fittings being arranged on the internal lateral side of the links and are invisible. The same is true for the locking means which, being associated to the modular unit articulating means and being linked to the fitting means, can also be located on the inside of the wristlet and can be hidden since they are linked to the fitting means which are likewise on the inside of the wristlet. They are accordingaly hidden as soon as two contiguous modular units are articulated one with another. Consequently, the locking means are hidden gradually during assembly of the links the one after another.

Accordingly, the lengthening or the shortening of the wristlet is possible without difficulty, and can be accomplished any where by a re-seller and without leaving a visible indication. Indeed, all links are dismountable without allowing their assembly to show from outside the wristlet.

The fitting surfaces are machined, so that the fittings can be realized with great accuracy. Each link can be brought to a desired finished state, either a final state, or an intermediate state, offering a great manufacturing flexibility. In case of damage, it is possible to disassemble the wristlet up to the damage in order to repair or replace it. Accordingly, it is not necessary to return the wristlet to the factory to perform this operation as is the case for non dismountable wristlets. After-sale service is accordingly simplified and improved since the repair can be done at the re-seller.

Other features and advantages will appear when reading the description which follows in which two embodiments and different variants of the present invention will be described and illustrated, schematically and as shown in the drawings.

DETAILED DESCRIPTION OF THE DRAWINGS

Figure 1:
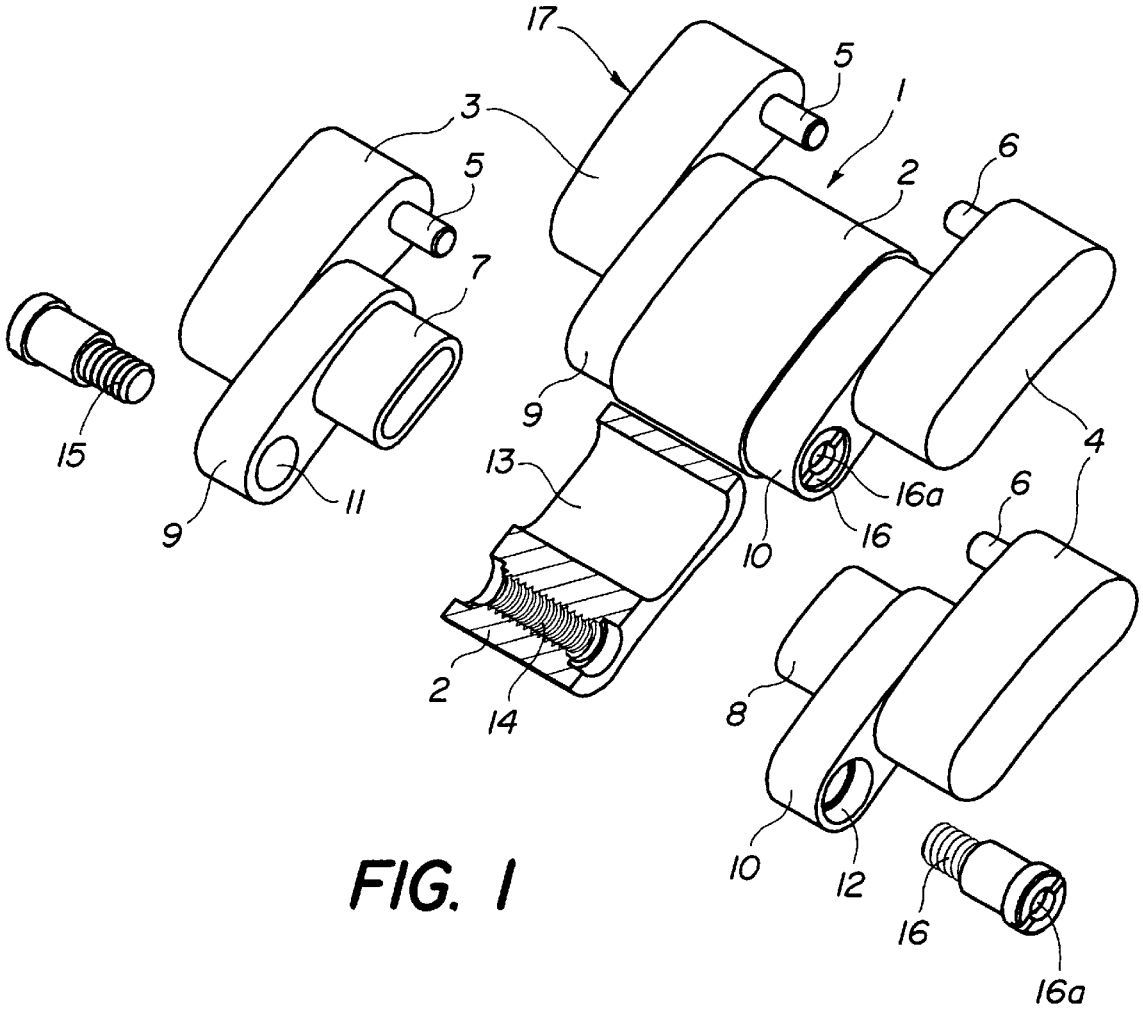
FIG. 1 is a partial view in perspective of a segment of a wristlet of which three links forming a modular unit, according to the first embodiment, are illustrated in a non-fitted position.

FIG. 1 shows a segment of a wristlet 1, as well as three links, a center link 2 and two lateral links 3 and 4. Each lateral link 3, 4 comprises a respective pivoting rod 5, 6 and a respective surface 7, 8. This fitting surface, 7, 8 is formed, in this example, by a hollow profiled body, formed by cutting a tubular element, which is forced or brazed in a recess, which is not visible, arranged on the internal lateral side of each link 3, 4.

The profiled bodies forming the fitting surfaces 7, 8, respectively, pierce a middle element 9, 10. The fixing between the profiled bodies and the middle elements is realized by forcing or brazing. Each middle element 9, 10 is staggered longitudinally from link 3, 4, in the longitudinal axis of the wristlet 1. The part of this middle element 9, 10 which is staggered from respective links 3, 4, is respectively pierced by an opening 11 12, whose axle is transverse from the wristlet 1.

Center link 2 comprises a fitting surface 13 constituted by a path which is transverse to the axis of the wristlet 1 and whose section has a shape which is complementary to the fitting surfaces 7 and 8 from the lateral links 3 and 4. This center link 2 also comprises a transverse path 14 provided with a threading. This transverse path 14 is aligned on the openings 11 and 12 piercing the middle elements 9 and 10.

Two screws 15 and 16 are designed to pierce the respective openings 11 and 12 and screw in path 14. Openings 11 and 12 are shaped to each present a shoulder aiming to retain the head of the respective screws 15, 16 and to press respective middle elements 9, 10 against the center link 2, the fitting surfaces 7 and 8 being then fitted in the fitting surface which pierced the center link: the heads of the screws 15, 16 each present a cylindrical recess 15*a*, 16*a* of which only 16*a* is visible, coaxial with the axis of the respective screw. This cylindrical recesses functions is to receive the respective pivoting pins 5, 6 of both lateral links 3, 4, after being fitted in the center link 2.

These lateral links 3, 4 are then locked in this fitting position by screws 15 and 16. As soon as these links 2, 3, 4 are locked together, they form a modular unit 17 which operates as one and only one piece, articulated around the axis of the coaxial pivoting pins 5, 6, mounted pivotingly in the cylindrical recesses 15*a*, 16*a*.

All the links of the wristlet are assembled one after another as just described. Each assembly of a modular unit 17, is formed by a center link 2 and two lateral links 3, 4 being locked by the screws 15, 16 which also function as pivoting organs between modular unit 17. It should be noted that it is not indispensable that each modular unit 17 be locked by screws 15, 16. It would suffice that only the last modular unit 17 of the wristlet or of the strand, when the wristlet is formed by several strands, be locked by one or two screws so that all the successive modular unit be locked.

Indeed, each pair of lateral links 3, 4 of a modular unit 17 encloses the middle elements 9, 10 joined to the links 3, 4 of the preceding modular unit 17 and prevents them from becoming unfitted as soon as these middle elements 9, 10 are taken in-between center link 2 and lateral links 3, 4 of a following modular unit 17. Consequently, if only the last modular unit 17 is locked by one or two screws 15, 16, (a single screw can screw in a threading area in the opposed middle elements 9, 10, instead of the threading arranged in the center link 2), all modular units 17 located between the first and the last modular unit 17 are locked. Additionally, it is possible to place screws 15, 16 only one every second or third module.

For the same reasons, it can be seen that screws 15 and 16 cannot become unscrewed, since they are retained by both lateral links 3, 4 of the next modular unit against which they get stuck as soon as they begin to unscrew. This assembly mode, entirely dismountable, is for this reason also completely hidden, since only the last screw(s) appear(s) on the lateral side of the lateral links 3, 4 at the extremity.

Of course, for manufacturing reasons, it is generally advantageous to realize the different links or at least some among them from several pieces which are assembled by forcing or brazing. As already mentioned, lateral links 3 and 4 can advantageously be realized with four assembled pieces. In this example, center link 2 is one piece.

Figure 2:
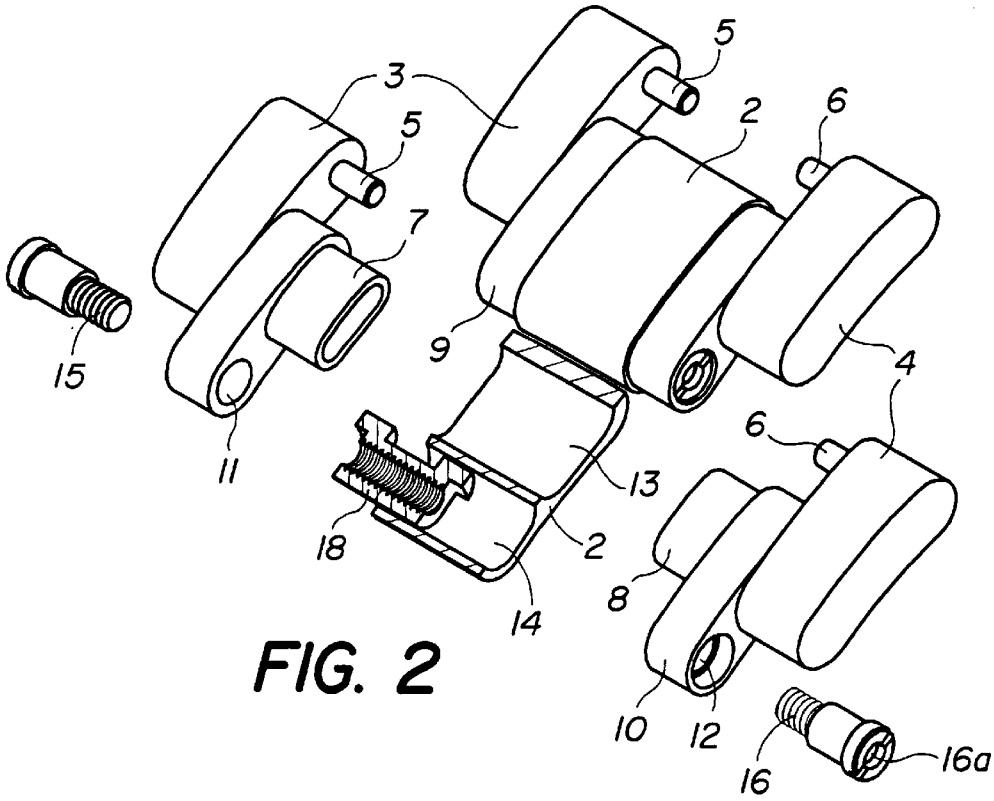
FIG. 2 is a view similar to FIG. 1 of a variant of this first embodiment.

In the variant illustrated in FIG. 2, center link 2 is disclosed in which the threading, arranged in the transverse part 14, is carried by an independent cylindrical piece 18, constituting a floating nut, disposed in the transverse path 14.

This represents a variant aimed to facilitate manufacturing since, half the center link 2 can then be a simple extruded element that one can cut up the desired width.

As can be seen, in the embodiment and the variant just described in FIG. 1 and 2, the center link has a rectangular profile when viewed in plan and, after assembly of the modular unit 17, with both middle elements 9, 10 disposed on each side, a composite center link also with a rectangular shape . Center link 2 by itself is, preferably, embossed when compared to middle elements 9, 10, conferring an original ornamental appearance. This center link 2 could have profiles other than that which is illustrated, the contiguous side of both middle elements 9, 10, then corresponding to the profile of the center link 2 and forming preferably with it a rectangular composite link, to the shape of link 2.

Of course, the disclosed shapes are not restrictive, but are simply disclosed here to show the aesthetical possibilities that this embodiment allows. It can also be seen that advantageously, all center links, each formed by one center link 2 and two middle elements 9, 10, have the same width on all the links of the wristlet 1. When it is a watch-wristlet in particular, the width of each of the strands of the wristlet, diminishes progressively from the fixation to the watchcase toward the clasp. In this case, this diminution in width can, preferably, be realized by reducing the width of lateral links 3, 4.

Figure 3:
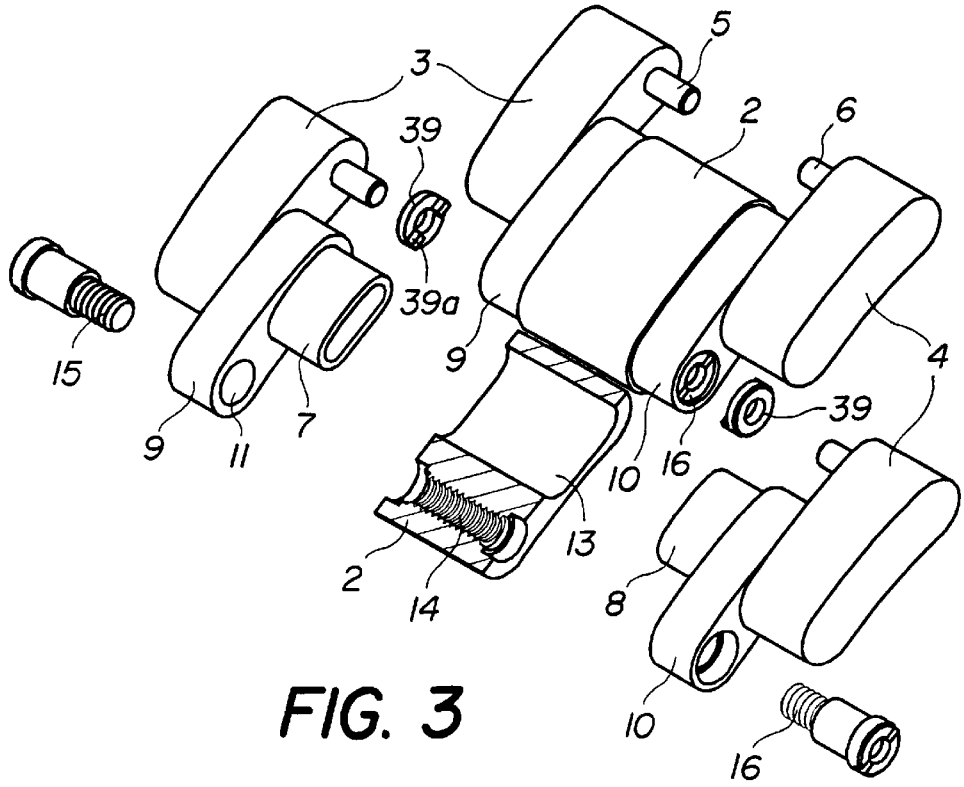
FIG. 3 is a view similar to FIG. 1 illustrating another variant of this first embodiment.

According to still another variant, illustrated in FIG. 3 as a variant of the first embodiment, a water-resistant joint 39 is disposed around the pivoting pins 5, 6. This joint is shaped to present a diametrical rib 39*a* aimed to engage in the slip of each of the screws 15 and 16 to make it interdependent with these crews. This joint protects the pivoting surfaces from the infiltration of foreign elements, abrasive or corrosive, which are detrimental to the proper operation of pivoting organs, or members. It is also possible to put a water-resistant joint at the bottom of the screws heads 36, 37 in the second embodiment.

Figure 4:
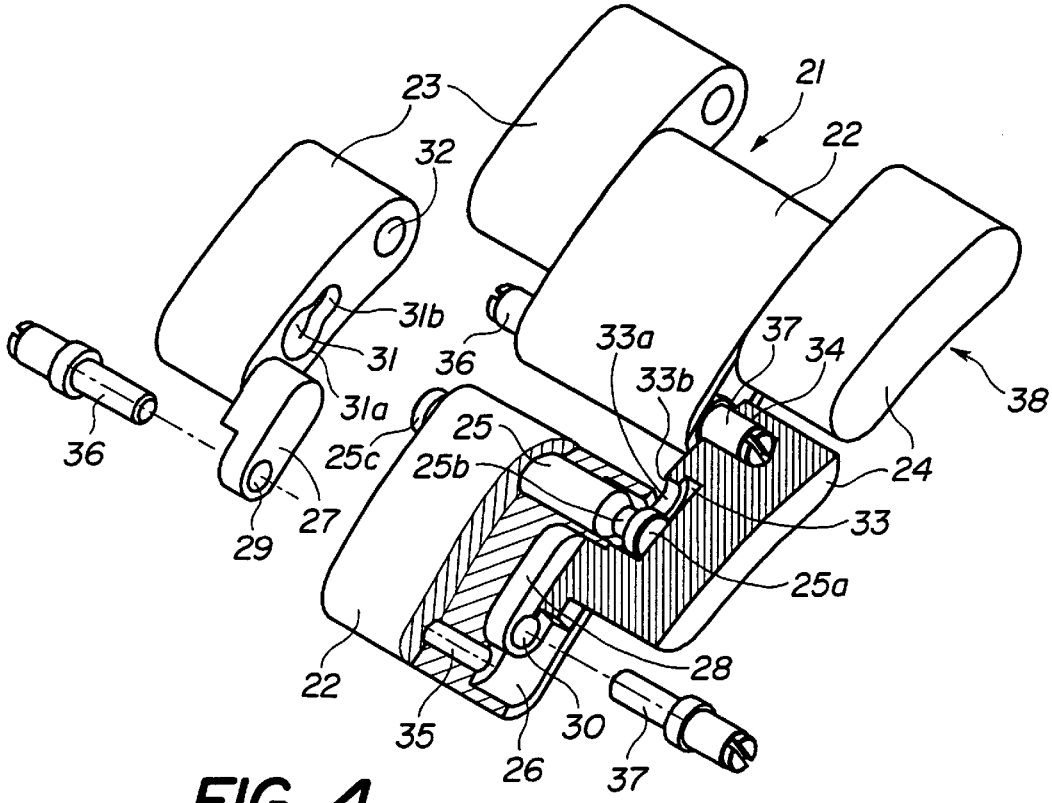
FIG. 4 is a view similar to FIG. 1 of a second embodiment with cut parts, illustrating the elements in a non-fitted position.
Figure 5:
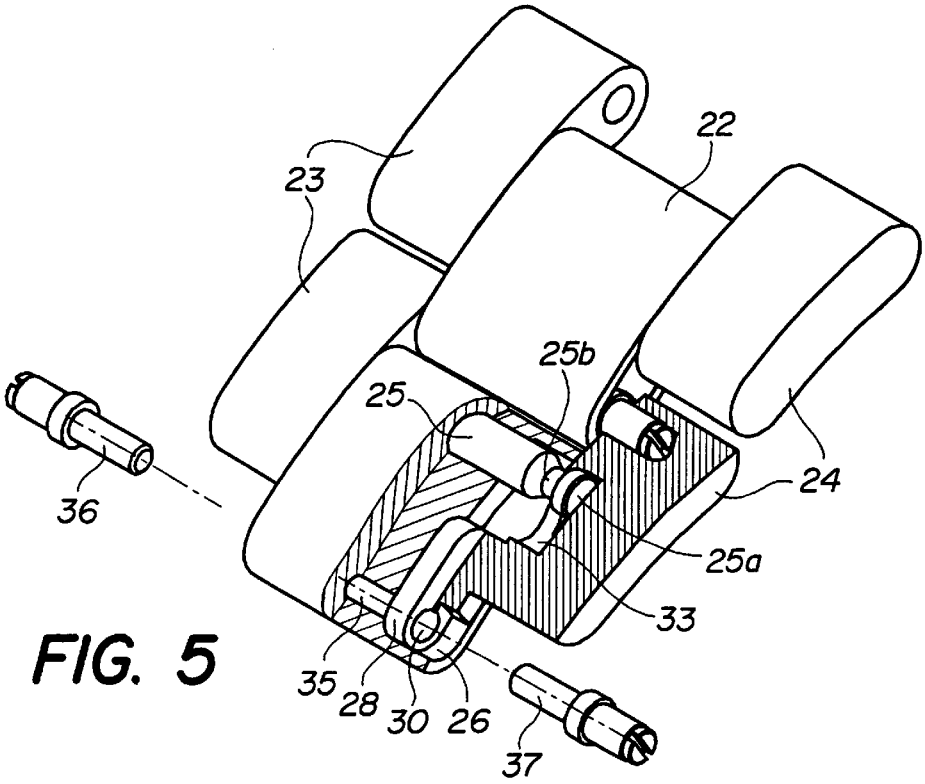
FIG. 5 is a view similar to the FIG. 4 illustrating the elements in locked position.

The second embodiment illustrated in FIGS. 4 and 5 is based on the same principle as the first embodiment, but differs in its realization.

This embodiment show a wristlet 21, of which only one segment is illustrated, formed by a row of center links 22 and by two rows of lateral links 23, 24. The last center link 22 and the two last lateral links 23, 24 are presented unmounted.

A rod 25 pierces a transverse path arranged in one extremity of center link 22. This rod 25 extends outside of the lateral opposed side of this link. Two annular grooves 25*a*, 25*b* of which only the latter is shown, are arranged between the two respective extremities of this rod and the respective opposed lateral sides of center link 22, with both heads 25*c*, 25*d* at both extremities of rod 25 free.

The opposed lateral sides of center link 22 each comprise one hollow cavity of which only one, 26, is shown. These hollow cavities 26 form sliding ways each of which is designed to receive and guide one of the middle elements 27, 28 fixed at the internal lateral side of respective lateral links 23, 24. These middle elements 27, 28 are longitudinally staggered from lateral links 23, 24. As in the preceding embodiment, the part of each middle element 27 28 which extends beyond respective lateral links 23, 24 is pierced by a respective opening 29, 30.

A second path 35, provided with an interior threading pierces the center link 22, near its transverse extremity which is opposed to that pierced by rod 25.

The internal lateral sides of lateral links 23, 24, each comprise two recesses 31, 32, respectively 33, 34. Recesses 31, 33 each comprise one opening 31*a*, 33*a* giving access to these respective recesses. These openings 31*a*, 33*a* each present a circular part, the diameter of which is slightly grater than that of heads 25*c*, 25*d* to allow their introduction in respective recesses 31, 33. These openings 31*a*, 33*a* are followed by a narrower part, the width of which is slightly greater than the diameter of the annular grooves 25*a*, 25*b* of rod 25. The narrower parts of these openings 31*a*, 33*a* form lips 31*b*, 33*b*, operating to retain the heads 25*c*, 25*d* in respective recesses 31, 33. The second recesses 32 and 34, have a circular cylindrical section.

When heads 25*c*, 25*d* of these rods are introduced in recesses 31 and 33 through the circular part of openings 31*a* and 33*a*, the middle elements 27, 28 engage in the sliding ways formed by recesses 26 of center link 22. Nevertheless, as can be seen on FIG. 4, these middle elements 27, 28 are located at some distance from the extremity of these recesses 26, so that the openings 29, 30 are out of axis when compared to opening 35.

Recesses 31, 33 are designed and sized to permit the center link 22 to move longitudinally when compared to lateral links 23, 24, on a distance corresponding to that between the extremities of middle elements 27, 28 and the respective contiguous extremities of recesses 26 of center links 22, in which they are slidingly engaged. Consequently, in order to lock the three assembled links 22, 23, 24, it is sufficient to slide the center link 22 from the position illustrated in FIG. 4 to that illustrated in FIG. 5.

This translation permits alignment of openings 29, 30 on the axis of the path 35 located at one of the extremities of center link 22. Simultaneously, this translation engages the annular grooves 25a in the narrow parts of openings 31*a*, 33*a*, thereby preventing the heads 25*c*, 25*d* of rod 25 from getting out of recesses 31*a*, 33*a*. The assembly is then locked in this position, by screwing two screws 36, 37 at both extremities of threaded path 35, through openings 29, 30, thereby keeping center link 22 from any longitudinal movement. The heads of these two screws 36, 37 are constituted by cylinders which protrude laterally from center link 22 and are designed to engage in recesses 32, 34 of opposed lateral links 23, 24, during assembly of the links 22, 23, 24 to form one of the modular units 38 of wristlet 21. This wristlet can be lengthened by a successive modular unit 38 in a manner as just described, until that the desired length is obtained.

This second embodiment has been more specially, although not exclusively, applied to small dimension wristlets, notably ladies watch wristlets. Accordingly, instead of realizing the pivoting of the modular units by forcing the pivoting pins 5, 6 of FIG. 1 in cylindrical recesses 15*a*, 16*a* of the heads of the screws 15 and 16, one forces the cylindrical heads of screws 36, 37 in recesses 32, 34, which permits smaller diametrical screws than in the first embodiment.

Of course, in the second embodiment, the path 35 could have no threading and receive a single rod which extends through it and protrudes laterally from both sides of link 22 and lodges in recesses 32, 34 of lateral links 23, 24, instead of the two screws 36, 37. This rod would lock the assembled links of the modular unit 38, as do screws 36, 37. The last modular unit only must be locked by one or two screws, since a single rod sliding through path 35 and opening 29, 30 would not then be laterally held by lateral links 23, 24 of the next modular unit.

Some functional parts of the wristlet according to the invention could be realized in different materials than the other parts. This is notably the case for the organs, or members, aimed to the pivoting of the modular units 17 or 38 between them. ccordingly, one could realize these parts or their surfaces ith, for example, a ceramic material. One of these pivoting urfaces could also be coated by a lubricating material. Such arrangements could further reduce the necessary clearance between the surfaces and to improve the accuracy of the assembly and of the articulation between the different elements of the wristlet.

What is claimed is:

1. Wristlet having articulated links, comprising:

a plurality of modular units;

wherein each modular unit includes at least three adjacent links;

wherein said at least three adjacent links of said module include two lateral links, said lateral links of said module unit being longitudinally positioned substantially the same with respect to each other and being positioned longitudinally staggered with respect to an adjacent link;

wherein each modular unit includes members for articulation between contiguous modular units, said members extending along transverse axles of said modular unit and being inserted into respective parts of said contiguous modular units;

wherein an internal lateral side of each of said lateral links of said modular unit and a lateral side of said adjacent link are coupled by means for laterally fitting the links one within each other in a defined position;

wherein the members for articulation between contiguous modular units include screws; and wherein the members for articulation between contiguous modular units include means for longitudinally or laterally locking said fitting means so that the links of each modular unit are fixed in said defined position.

2. Wristlet according to claim 1, wherein water-resistant means are provided to protect the pivoting surfaces between said modular units.

3. The wristlet according to claim 1, wherein said members for locking the lateral link and the adjacent link fitted one in each other includes a first opening provided at the transverse extremity of said adjacent link protruding longitudinally from the lateral link, and a second opening through an extremity of a longitudinal extension of the lateral link;

wherein the transverse dimension in fitting position of the extension corresponds to the clearance between two lateral links of the contiguous modular unit;

wherein the locking members axially join said first opening and said second opening;

wherein each of said locking members include articulation member; and wherein the internal articulation member of said lateral link of one modular unit interconnects with articulation member portions of the locking member of a contiguous modular unit, wherein two interconnected articulation members substantially comprise complementary cylindrical shapes and opening co-axial with one another.

4. Wristlet according to claim 3, wherein said longitudinal extension of the lateral link forms a sliding block which engaged a sliding-way formed in the lateral side of the adjacent link, said sliding-way limiting the longitudinal positions between the adjacent link and the lateral link;

wherein a rod, said rod including a head at each extremity, protrudes from the lateral side of the adjacent link contiguous to the lateral link;

wherein the internal lateral side of the lateral link includes an opening to receive said head, said opening permitting said head to move in one of the two relative limiting longitudinal positions between the adjacent link and the lateral link, said opening permitting access to a recess sized to allow movements of said head a distance corresponding to the amplitude of relative movement between said slide-way and said sliding-block;

wherein said opening includes a shoulder, said shoulder shaped to axially retain said head in the other of the relative limited positions between the adjacent link and the lateral link, this position corresponding to the position wherein said first and said second openings are axially lined up.

5. Wristlet according to claim 4, wherein said longitudinal extension is formed by a link which is interdependent with said lateral link.

6. Wristlet according to claim 4, wherein water-resistant means are provided to protect the pivoting surfaces between said modular units.

7. Wristlet according to claim 3, wherein said longitudinal extension is formed by a link which is interdependent with said lateral link.

8. Wristlet according to claim 3, wherein water-resistant means are provided to protect the pivoting surfaces between said modular units.

9. Wristlet according to claim 3, wherein said first opening in said adjacent link includes internal threads;

wherein said second opening through an extremity of a longitudinal extension the lateral link is shaped to receive the head of said screw; and wherein said screw engages said threads of said first opening.

10. Wristlet according to claim 9, wherein the head of the locking screw comprises a rod shaped articulation member protruding from said adjacent link; and wherein articulation member of the lateral link comprises a cylindrical complementary cavity which engages said rod shaped articulation member.

11. Wristlet according to claim 10, wherein said longitudinal extension of the lateral link forms a sliding block which engaged a sliding-way formed in the lateral side of the adjacent link, said sliding-way limiting the longitudinal positions between the adjacent link and the lateral link;

wherein a rod, said rod including a head at each extremity, protrudes from the lateral side of the adjacent link contiguous to the lateral link;

wherein the internal lateral side of the lateral link includes an opening to receive said head, said opening permitting said head to move in one of the two relative limiting longitudinal positions between the adjacent link and the lateral link, said opening permitting access to a recess sized to allow movements of said head a distance corresponding to the amplitude of relative movement between said slide-way and said sliding-block;

wherein said opening includes a shoulder, said shoulder shaped to axially retain said head in the other of the relative limited positions between the adjacent link and the lateral link, this position corresponding to the position wherein said first and said second openings are axially lined up.

12. Wristlet according to claim 10, wherein said longitudinal extension is formed by a link which is interdependent with said lateral link.

13. Wristlet according to claim 10, wherein water-resistant means are provided to protect the pivoting surfaces between said modular units.

14. Wristlet according to claim 9, wherein said longitudinal extension of the lateral link forms a sliding block which engaged a sliding-way formed in the lateral side of the adjacent link, said sliding-way limiting the longitudinal positions between the adjacent link and the lateral link;

wherein a rod, said rod including a head at each extremity, protrudes from the lateral side of the adjacent link contiguous to the lateral link;

wherein the internal lateral side of the lateral link includes an opening to receive said head, said opening permitting said head to move in one of the two relative limiting longitudinal positions between the adjacent link and the lateral link, said opening permitting access to a recess sized to allow movements of said head a distance corresponding to the amplitude of relative movement between said slide-way and said sliding-block;

wherein said opening includes a shoulder, said shoulder shaped to axially retain said head in the other of the relative limited positions between the adjacent link and the lateral link, this position corresponding to the position wherein said first and said second openings are axially lined up.

15. Wristlet according to claim 9, wherein said longitudinal extension is formed by a link which is interdependent with said lateral link.

16. Wristlet according to claim 9, wherein water-resistant means are provided to protect the pivoting surfaces between said modular units.

17. Wristlet according to claim 9, wherein said screw includes a cylindrical recess, said cylindrical recess comprising an opening complementary and co-axial with a rod shaped articulation member positioned on said lateral link.

18. Wristlet according to claim 17, wherein said longitudinal extension of the lateral link forms a sliding block which engaged a sliding-way formed in the lateral side of the adjacent link, said sliding-way limiting the longitudinal positions between the adjacent link and the lateral link;

wherein a rod, said rod including a head at each extremity, protrudes from the lateral side of the adjacent link contiguous to the lateral link;

wherein the internal lateral side of the lateral link includes an opening to receive said head, said opening permitting said head to move in one of the two relative limiting longitudinal positions between the adjacent link and the lateral link, said opening permitting access to a recess sized to allow movements of said head a distance corresponding to the amplitude of relative movement between said slide-way and said sliding-block;

wherein said opening includes a shoulder, said shoulder shaped to axially retain said head in the other of the relative limited positions between the adjacent link and the lateral link, this position corresponding to the position wherein said first and said second openings are axially lined up.

19. Wristlet according to claim 17, wherein said longitudinal extension is formed by a link which is interdependent with said lateral link.

20. Wristlet according to claim 17, wherein water-resistant means are provided to protect the pivoting surfaces between said modular units.

* * * * *